US005605330A

United States Patent [19]

Huang et al.

[11] Patent Number: 5,605,330

[45] Date of Patent: Feb. 25, 1997

[54] PORTABLE CONTAINER INVOLVING GAMES OF CHANCE

[76] Inventors: Wonder Huang, No. 51, Lane 2, Sec. 5, Changlu Rd., Lukang Chen, Changhua Hsien; Victoria Ho, 2nd Fl., No. 38, Lane 452, Chungcheng Rd., Chingfu Li, Hsinchu; Wei-po Hsu, No. 31, Lane 227, Kungyuan Rd., Tungyuan Li, Hsinchu, all of Taiwan

[21] Appl. No.: 525,996

[22] Filed: Sep. 8, 1995

[51] Int. Cl.[6] ..... A63F 9/00

[52] U.S. Cl. ..... 273/142 R; 273/357; 273/368; 273/399; 273/405; 273/287; 273/142 A; 273/192 G; 124/16; 206/315.1

[58] Field of Search ..... 273/142 R, 142 D, 273/142 E, 142 F, 142 G, 280, 287, 328, 355, 356, 357, 368, 397, 905; 124/16, 79; 206/315.1

[56] References Cited

U.S. PATENT DOCUMENTS 4,253,669 3/1981 Ferris et al. ..... 273/368

4,928,968 5/1990 Gebert ..... 273/357

FOREIGN PATENT DOCUMENTS 96910 7/1939 Sweden ..... 273/142 R 604791 9/1978 Switzerland ..... 273/142 R 375631 6/1932 United Kingdom ..... 273/142 J

*Primary Examiner* –Benjamin H. Layno

*Attorney, Agent, or Firm*—Kirkpatrick & Lockhart LLP

[57] ABSTRACT

A portable container for playing games of chance comprises a box combined by a cover and a base, a rotatable means whose components are disposed in the cover and the base when carried. A number of bouncers are provided on the base for playing. Disks are inserted in the bouncers and bounced by the springs within the bouncers to the assembled rotatable means so that the positions of the rotatable means in which the disks drop determine the scores of the players.

11 Claims, 7 Drawing Sheets

PORTABLE CONTAINER INVOLVING GAMES OF CHANCE

BACKGROUND OF THE INVENTION

1. Field of the Invention

The present invention relates to a portable container involving games of chance, particularly a portable container having a rotatable means and at least one resilient means, for providing various games of chance for a user, especially when in a traveling situation.

2. Related Arts

Throughout history, mankind has been excited by games of chance, both primitive and complex, wherein a player may win more than his or her normal ration. Trying to predict the final destination of a ball, such as in roulette, or simply flipping playing cards into an upturned hat have held fascination for people of all ages. However, such games are unsuitable when a player is traveling on a train or bus etc. where there is insufficient space, or equipment involved in such games may become lost. Thus, there is a need for a portable and compact container in which mechanisms are disposed to provide impartial urging means to project ball or disk-like tokens, and also defining therein recesses to store the tokens, balls etc. so that they will not get lost.

SUMMARY OF THE INVENTION

Briefly stated, the primary objective of the present invention is to provide a portable box having a rotatable means and at least one bouncer for various games of chance appliance.

In accordance with one aspect of the invention, there is provided a box combined by a cover and a base, a rotatable means whose components are disposed in the cover and the base combined to be carried. The rotatable means can be assembled when used for play as a rotatable plate, with a mantel covering the block of the rotatable plate, a guide post supporting the rotatable plate and a spring mounted around the guide post, all disposed in a socket. The rotatable plate thus is permitted to rotate in the socket. Several protruding curved strips dividing the surface of the rotatable plate are provided for determining the scores of playing.

In accordance with another feature of the present invention, at least one bouncer which can be assembled for playing is disposed in the box. The bouncer comprises a cup, a button engaging internally in the cup and having a slot defined in a top thereof for a card or disk to be inserted therein, a pin having a shank thereunder and being elevated between the cup and the button and a spring mounted around the shank of the pin for providing a bounce effect to a head of the pin. By this arrangement, cards which are inserted in the slot of the cup can be urged upwardly by the spring to the rotatable plate for play.

Additional features of the invention will be described hereinafter which form the subject of the claims of the invention.

DETAILED DESCRIPTION OF PREFERRED EMBODIMENT

Figure 1:
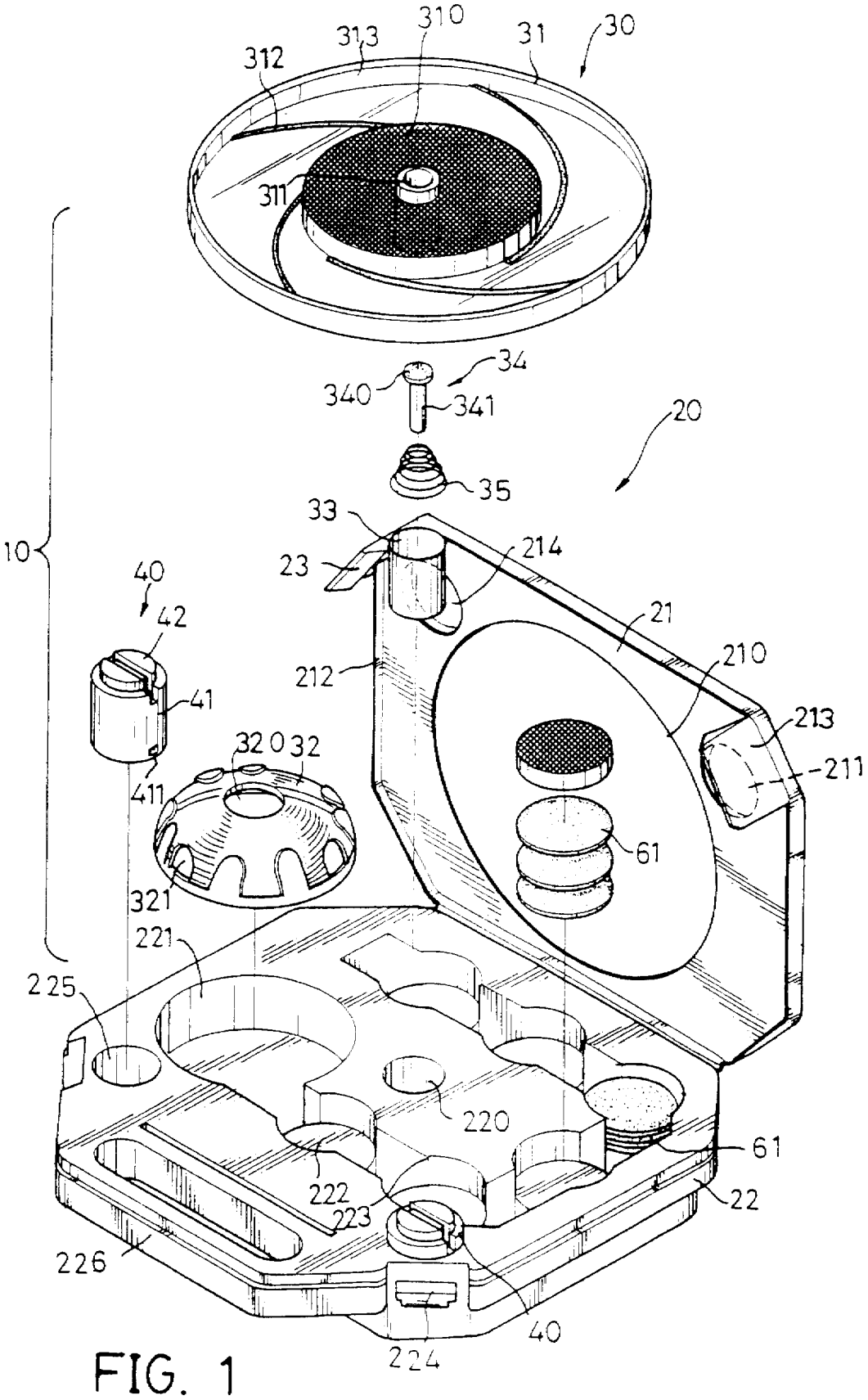
FIG. 1 is a perspective view of the portable container for playing cards in accordance with the present invention, showing the construction and relation of each components.

With particular reference to FIG. 1, there is shown a perspective illustration of a portable container 10 for playing games of chance constructed in accordance with the principles of the present invention. The apparatus 10 comprises a box 20 combined by a cover 21 and a base 22 and a rotatable means 30 whose components are disposed in the cover 21 and the base 22 when carried and can be assembled when used for playing.

Figure 3:
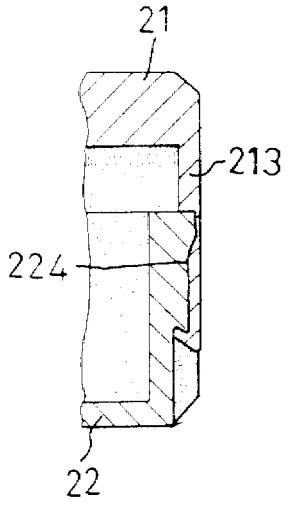
FIG. 3 is a schematic view showing the engagement of the cover with the base of this invention.

The cover 21 has an opening 210 defined in a center thereof and the base 22 has a smaller hole 220 defined in a center thereof, a larger hole 221 and a plurality of pockets 222 for containing cards disposed around the smaller hole 220. The base 22 of the box 20 further comprises a stepped edge (not numbered) therearound and two hooks 224 disposed on two ends of one side thereof. The cover 21 of the box 20 has a lip 212 therearound for co-operating with the stepped edge of the base 22 and two tabs 213 with respect to the hooks 224 for securing the base 22 so as to form the box 20 (as shown in FIG. 3). The base 22 further comprises a handle 226 at one side for a user to conveniently carry the container 20.

Figure 4:
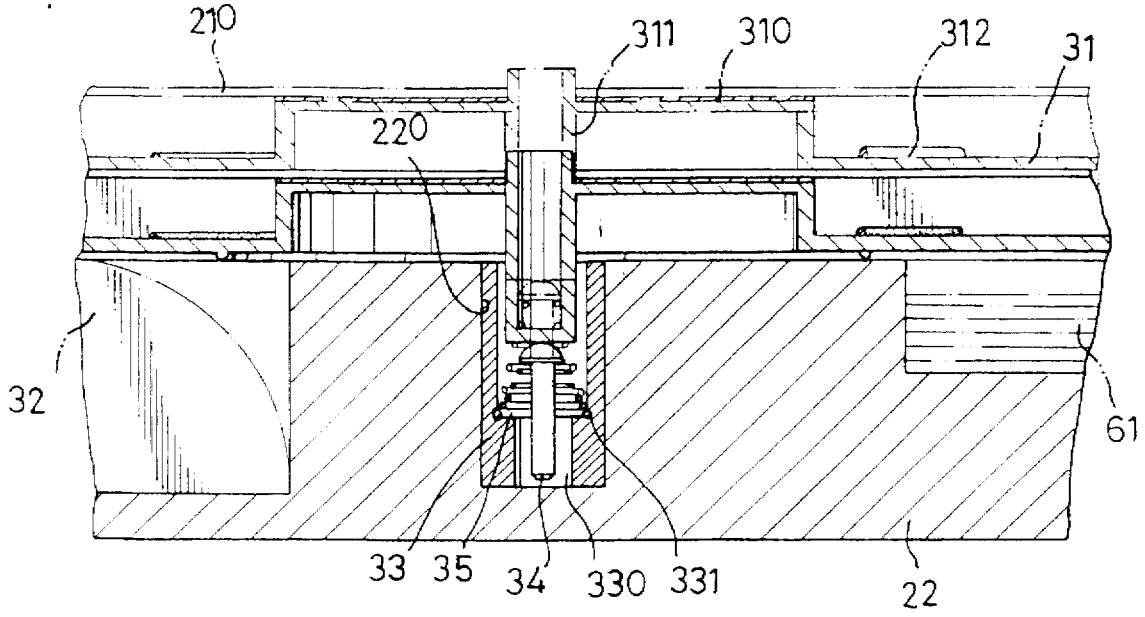
FIG. 4 is a cross-sectional view of the rotatable means showing the configuration of the central shaft of the rotatable plate of this invention.

Referring to FIG. 1 and FIG. 4, the rotatable means 30 includes a rotatable plate 31 having a protruding block 310 and a central shaft 311 extending through the block 310, a hemispherical mantel 32 covering the block 310 of the rotatable plate 31, a socket 33 having a guide hole 330 (as shown in FIG. 4) for receiving the central shaft 311 under the rotatable plate 31, a guide post 34 and a spring 35 disposed in the socket 33, the guide post 34 having a head 340 for supporting the central shaft 311 and a body 341 for receiving the spring 35 thereon, the spring 35 provided for urging the central shaft 311 of the rotatable plate 31 to elevate in the socket 33. Wherein, the mantel 32 has a central hole 320 and a plurality of outlets 321 defined at appropriate positions. The rotatable plate 31 of the rotatable means 30 further comprises a number of protruding curved strips 312 disposed between the protruding block 310 and the lip 313 on the surface thereof. The guide hole 330 of the socket 33 of the rotatable means 30 is stepped and has a binding ring 331 (with reference to FIG. 4) disposed at the position having a shoulder defined between the larger internal diameter and the smaller diameter for supporting the spring 35 against falling away.

Figure 2:
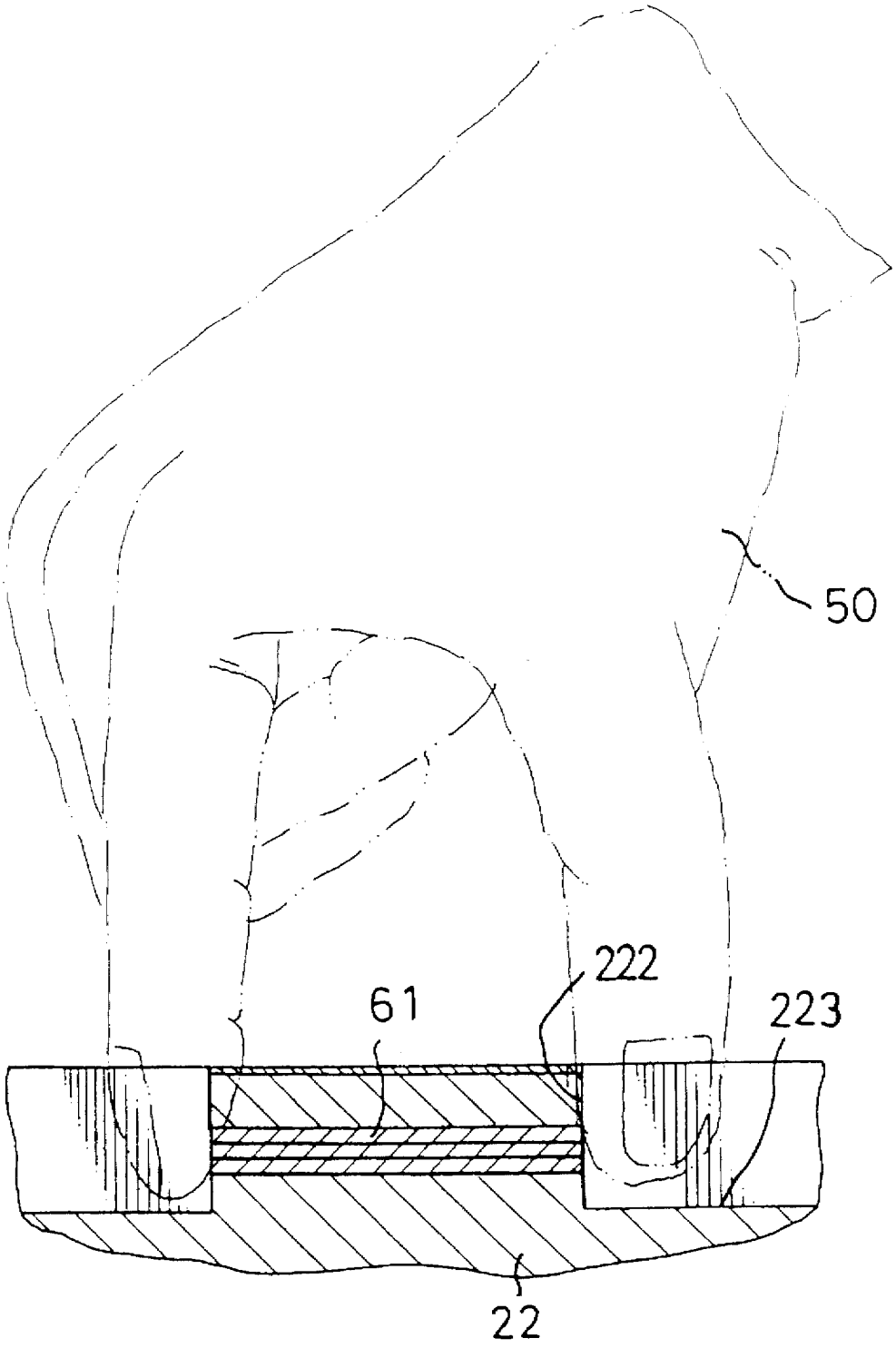
FIG. 2 is a schematic view showing the channel between the plurality pockets for containing the cards of the base of this invention.

When the rotatable means 30 is carried, the rotatable plate 31 is disposed in the central hole 210 of the cover 21 of the box 20, the mantel 32 with its height less than that of the base 22 is in the larger hole 221 of the base 22 of the box 20, the socket 33 is in the smaller central hole 220 of the base 22, at least one bouncer 40 is in a pit 214 disposed on the cover 21 and the cards 61 are in the pockets 222 of the base 22 which has a channel 223 with a depth larger than each of the plurality pockets 222 communicated the larger hole 221 of the base 22 with each of the pockets 222 for a finger 50 retrieving the cards 61 (as shown in FIG. 2).

Figure 5:
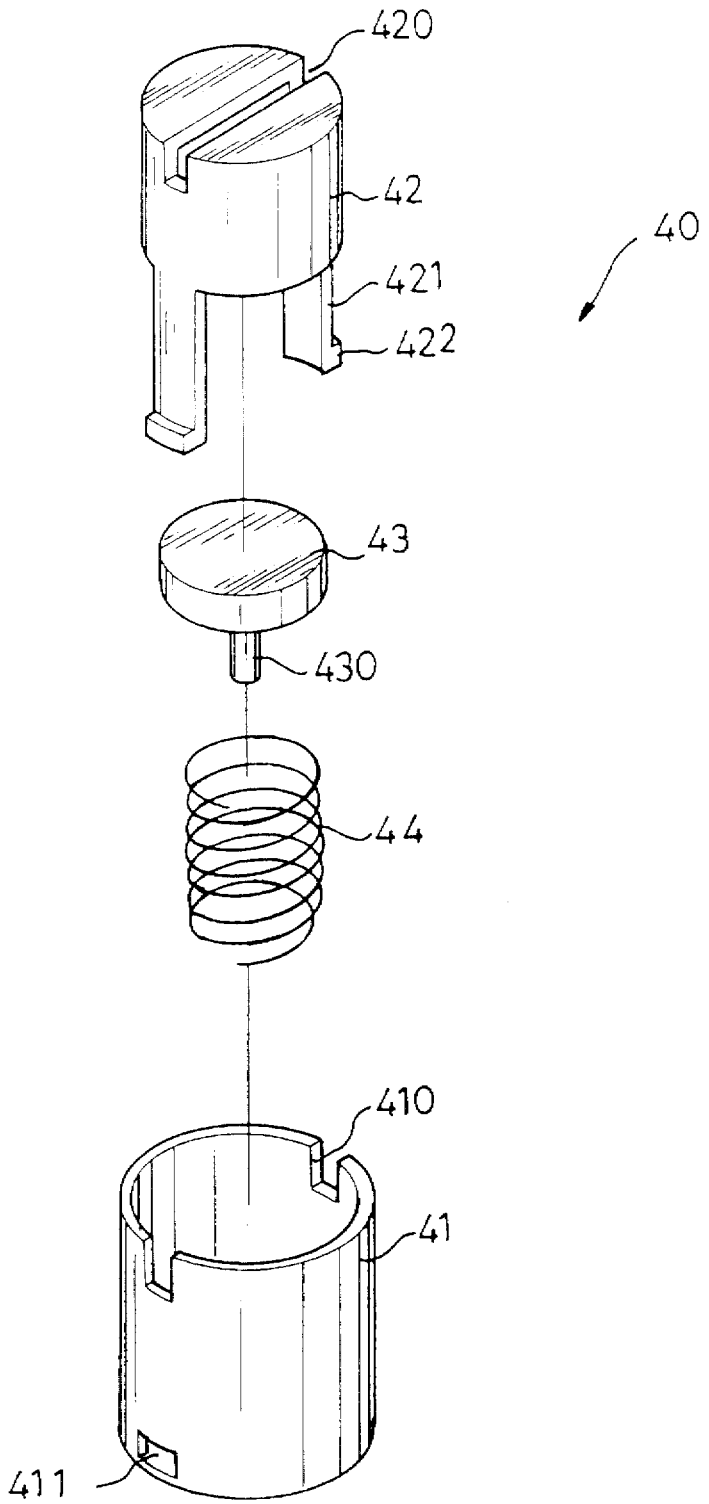
FIG. 5 is a perspective view of the bouncer of this invention.

Referring to FIG. 1 and FIG. 5, the apparatus 10 in accordance with the present invention further comprises at least one bouncer 40 disposed in a pit 225 defined with respect to the pit 214 of the cover 21 at proper position of the base 22, the bouncer 40 for playing comprising a cup 41 having two respective recesses 410 diametrically defined in an upper circumference thereof and two notches 411 each defined beneath one of the respective recesses 410 at an opposite end to the recesses, a button 42 engaging internally in the cup 41, having a slot 420 at a top with respect to the two recesses 410 of the cup 41 for edges of cards 61 to be inserted therein and two legs 421 extending from a bottom of the button 43 each leg 421 having a step 422 extending outwardly at the bottom of the button 43 for co-operating with the notches 411, a pin 43 which is elevated between the cup 41 and the button 42 having a shank 430 thereunder and a spring 44 mounted around the shank 430 of the pin 43 for urging upwardly a head of the pin 43, that is, when the cards 61 are inserted in the slot 420 of the button 42, the pin 43 compresses the spring 44 so that the cards 61 can be bounced by a restoring force of the spring 44, thus the appliance is played with.

Figure 6:
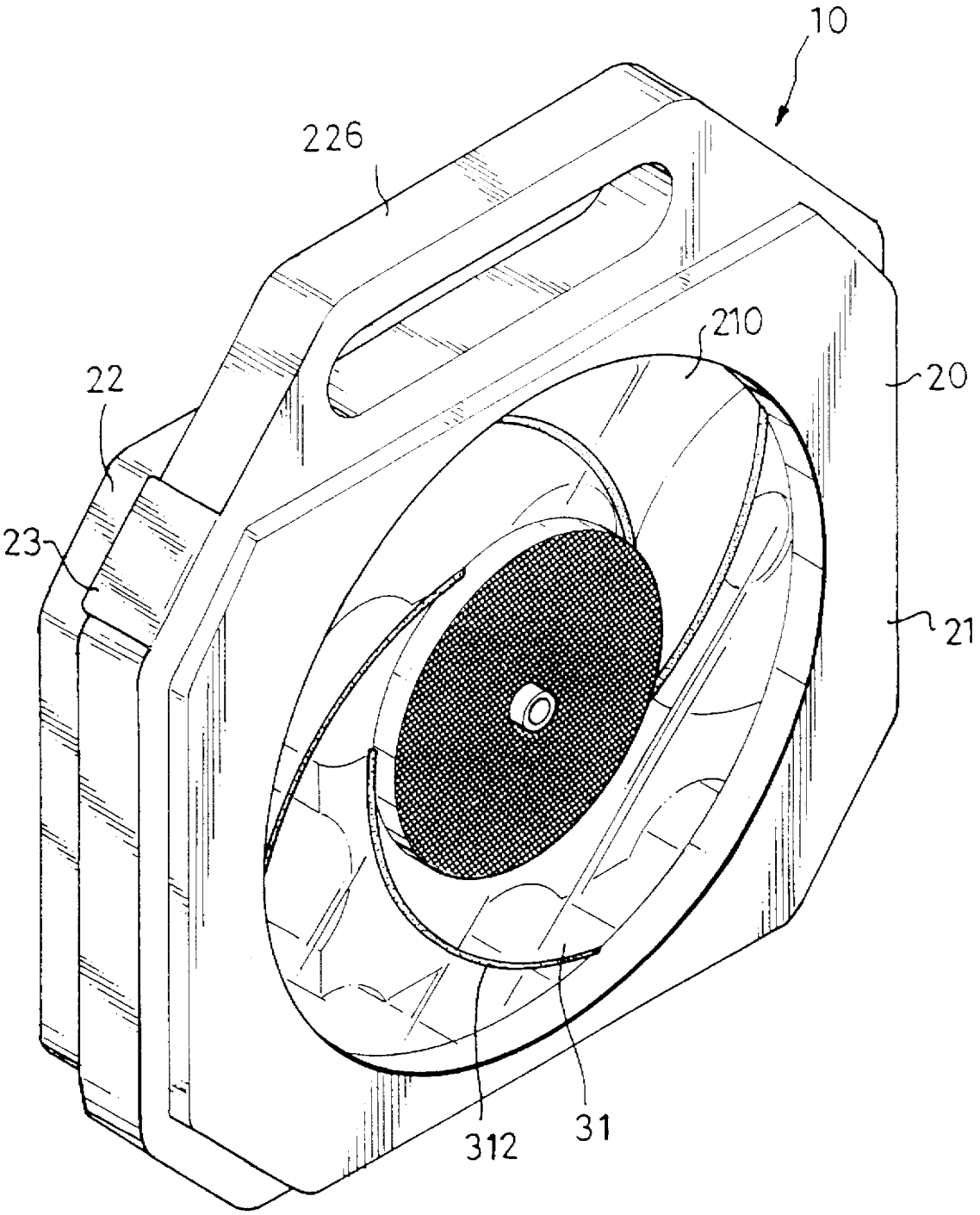
FIG. 6 is a schematic view showing the state when the box is closing of this invention.

FIG. 6 is a schematic view showing the state when the box 20 is closed. Wherein each component is contained therein so that the user can carry the container conveniently when traveling.

Figure 7:
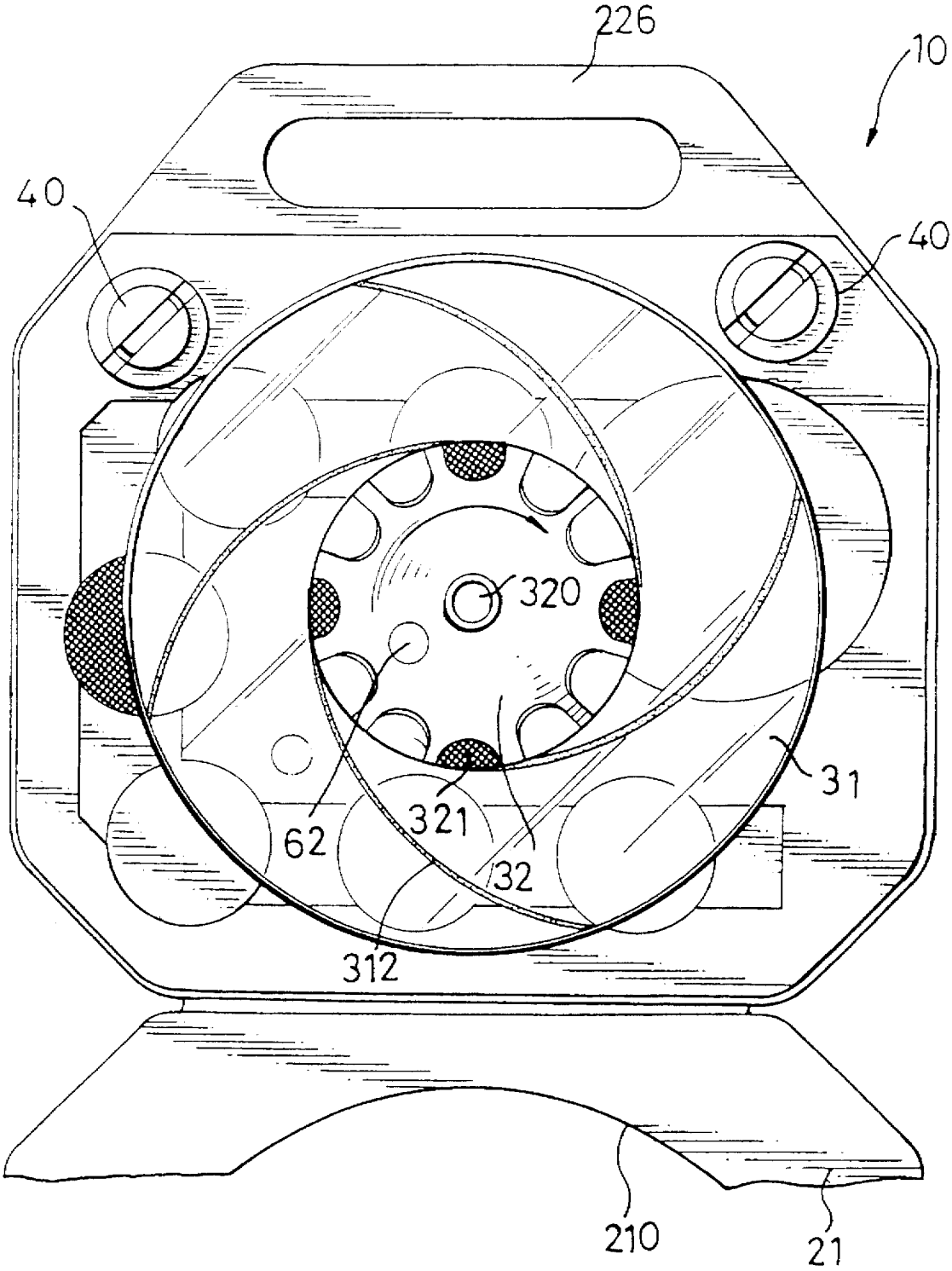
FIG. 7 is a vertical view of one embodiment of this invention, showing the state when the rotatable means is used for playing.
Figure 8:
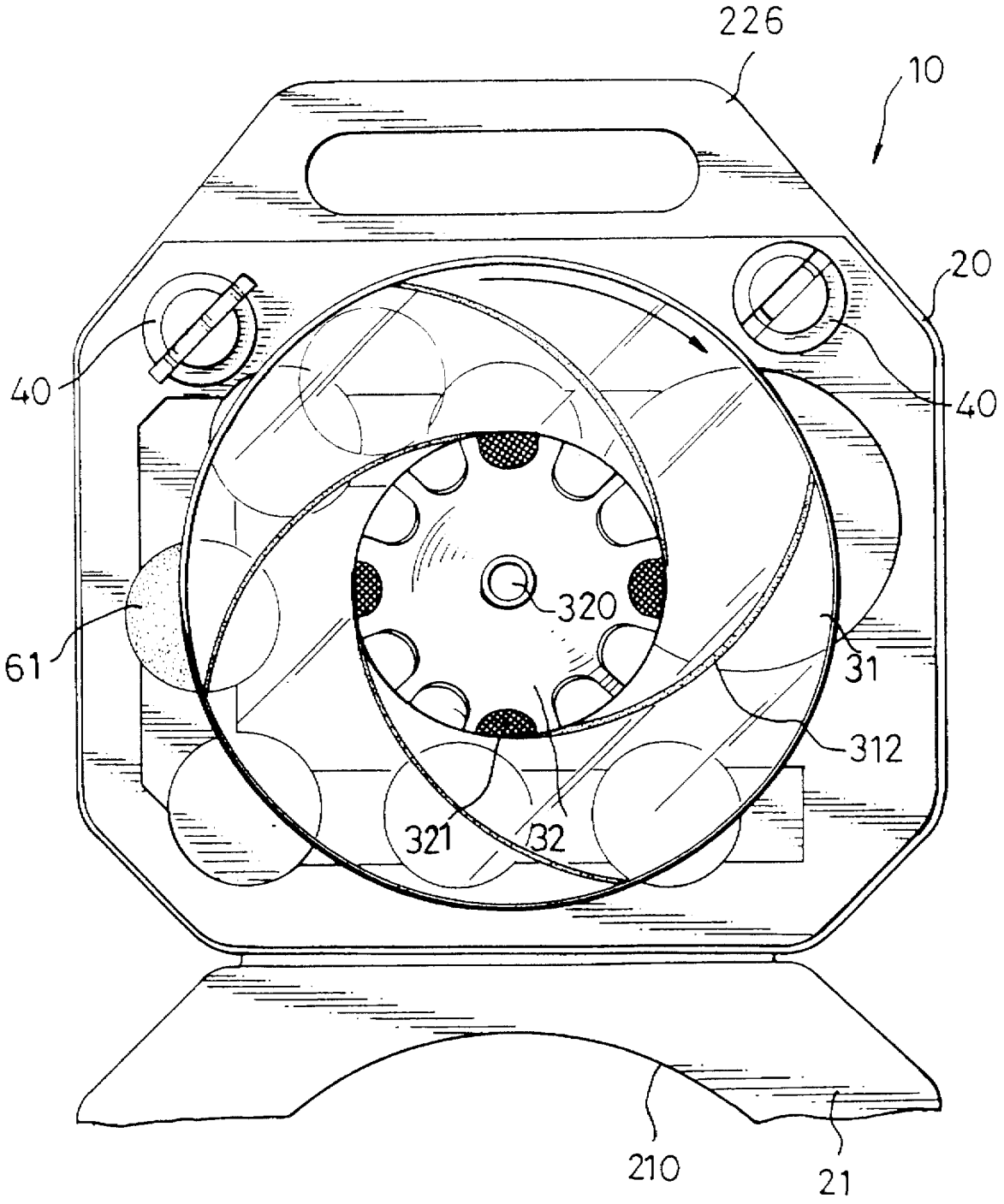
FIG. 8 is a vertical view of the other embodiment of this invention, showing the state when the rotatable means is used for playing.

FIG. 7 and FIG. 8 show the states when the rotatable means is used for playing of two embodiments in accordance with the present invention. First referring to FIG. 7, besides the conventional way of directly playing games of chance, the apparatus 10 provides a novel way of playing, that is to play a game by means of the rotatable means. As assembled in the previously mentioned manner, the rotatable plate 31 is covered by the mantel 32 and supported by the guide post 34 within the socket 33. The spring 35 mounted around the guide post 34 is not compressed at this moment so that the rotatable plate 31 can rotate on the guide post 34 (as shown in FIG. 4). Assuming there are several players each reserving a space (not numbered) separated by the protruding curved strips 312, a ball 62 is ejected from the central hole 320 of the mantel 32, by means of centrifugal force created by the rotation of the plate 31, to roll out from one of the outlets 321 and drop into the space in which a player reserves and so a player wins one disk. The winner is one who can get all disks by selecting said space correctly.

Now referring to FIG. 8, wherein a further manner of play is shown. The components of the rotatable means 30 are assembled as in the previously mentioned method. However, the protruding curved strips 312 are disposed with different heights on the rotatable plate 31. From one to three of the disks 61 are inserted in the slot 420 of the button 42 of the bouncer 40 to press the elevatable pin 43 so that the disks 61 can be bounced by a restoring force of the spring 44 within the bouncer 40 to the space separated by the protruding curved strips 312 when the rotatable means 30 is rotated. The positions with different heights of the spaces in which the disks drop determines the scores of the players.

Accordingly, the apparatus 10 in accordance with the present invention provides a portable container for games of chance. Particularly, the design of the rotatable means and the bouncer provides various methods of play.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What the invention claimed is:

1. A portable container for games of chance comprising:

a box combined by a cover and a base, the cover having a hole disposed in a center thereof, the base having a smaller hole in a center thereof, a larger hole and a plurality of pockets for containing disks disposed around the smaller hole;

a rotatable means whose components are disposed in the cover and the base when carried including a rotatable plate having a protruding block and a central shaft extending through the block, a mantel covering the block of the rotatable plate, a socket having a guide hole for receiving the central shaft under the rotatable plate, a guide post and a spring disposed in the socket, the guide post having a head for supporting the central shaft and a body for the spring to mount therearound, the spring provided for admitting the central shaft of the rotatable plate to elevate in the socket.

2. The container as claimed in claim 1, wherein the rotatable plate of the rotatable means, when carried, is disposed in the central hole of the cover of the box, the mantel is in the larger hole of the base of the box, the socket is in the smaller central hole.

3. The container as claimed in claim 1, wherein the base of the box has a stepped edge therearound and the cover of the box has a lip therearound for cooperating with the stepped edge so as to cover the base.

4. The container as claimed in claim 1, wherein the base of the box has two hooks disposed on two ends of one side thereof and the cover of the box has two tabs with respect to the hooks for securing the base.

5. The container as claimed in claim 1, wherein between the larger hole of the base and each of the pockets, there is provided a channel with a depth larger than a depth of each of the plurality pockets to enable a user to retrieve the disks easily.

6. The container as claimed in claim 1, wherein the base further comprises a handle at one side for a user to carry the box easily.

7. The container as claimed in claim 1, wherein the mantel of the rotatable means is hemispheroid and has a central hole and a plurality of outlets at a surface for play.

8. The container as claimed in claim 1, wherein the rotatable plate of the rotatable means further comprises a number of protruding curved strip disposed between the protruding block and the lip on the surface thereof for determining the scores of players.

9. The container as claimed in claim 1, wherein the guide hole of the socket of the rotatable means is stepped and has a binding ring disposed at the position having the larger internal diameter for supporting the spring.

10. The container as claimed in claim 1, wherein the base of the box further comprises at least one pit disposed for a bouncer to be inserted therein, the bouncer for playing comprising:

a cup having two respective recesses diametrically defined in an upper circumference thereof and two notches each defined beneath one of the respective recesses, a button engaging internally in the cup, having a slot at a top with respect to the two recesses of the cup for an edge of a disk or card to be inserted therein and two legs extending from a bottom of the button each leg having a step extending outwardly therefrom at the bottom for cooperating with said notches, a pin which is elevated between the cup and the button having a shank thereunder and a spring mounted around the shank of the pin for providing an urging upward effect to the pin.

11. The container as claimed in claim 1, wherein the cover of the box has at least one pit disposed therein with respect to the pit of the base for containing the bouncer when the container is carried.

* * * * *